United States Patent [19]

Gail et al.

[11] 4,396,113

[45] Aug. 2, 1983

[54] SLIDING SLEEVE FOR STORAGE OF SAMPLES

[75] Inventors: Lothar Gail, Wiesbaden; Klemens Thoma, Krefeld, both of Fed. Rep. of Germany

[73] Assignee: Messer Griesheim GmbH, Frankfurt am Main, Fed. Rep. of Germany

[21] Appl. No.: 307,204

[22] Filed: Sep. 30, 1981

[30] Foreign Application Priority Data

Nov. 15, 1980 [DE] Fed. Rep. of Germany ..... 3043270

[51] Int. Cl.[3] ..... B65D 85/00; B65D 3/04; B65D 81/18; B65D 55/02

[52] U.S. Cl. ..... 206/1.5; 206/807; 220/8; 220/214; 220/410

[58] Field of Search ..... 206/1.5, 45.34, 45.19, 206/807; 220/8, 214, 410

[56] References Cited

U.S. PATENT DOCUMENTS

| | | | |
|---|---|---|---|
| 392,682 | 11/1888 | McNamara | 220/8 |
| 1,120,276 | 12/1914 | Campbell | 220/214 |
| 3,406,821 | 10/1968 | Weissberg | 206/45.34 |
| 3,819,081 | 6/1974 | Runte | 220/410 |
| 3,844,407 | 10/1974 | Buie | 206/807 |

*Primary Examiner*—William T. Dixson, Jr.
*Attorney, Agent, or Firm*—Connolly and Hutz

[57] ABSTRACT

Samples of materials, such as biological materials, are stored in liquid nitrogen in containers arranged as sliding sleeves wherein the outer sleeve is longer than the inner sleeve and has an apertured protruding edge so that a sealed wire can be threaded therethrough.

3 Claims, 1 Drawing Figure

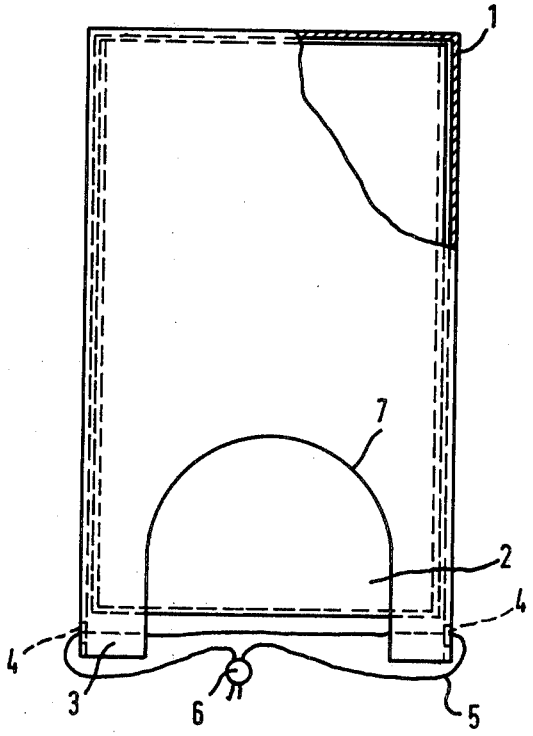
1
7
2
4
4
3
6
5

SLIDING SLEEVE FOR STORAGE OF SAMPLES

BACKGROUND OF INVENTION

The invention concerns a sliding sleeve for storage of samples under sterile conditions, particularly at low temperatures.

Sliding sleeves consist of an inner and an outer cylindrical sleeve, which may be slid into each other at the openings. The interior space of the sliding sleeves pushed into each other is protected against particulate air-carried contamination. For this reason, it has long been used for items that must be packaged under sterile conditions. Recently, they have also been used in cryobanks. In these cryobanks, customers can have any sample preserved by means of liquid nitrogen for any length of time. Primarily, this applies to biological material which has unlimited storage life only at the low temperatures of the liquid nitrogen, such as, for instance, genetic material of rare species of animals and plants, rare blood groups, and small human organ parts. However, technical and chemical materials can also be stored in this manner, for instance, flavor and fragrance materials which cannot yet be fully comprehended analytically.

Since, in many cases, these samples constitute irreplacable materials, the clients frequently desire to protect the sliding sleeves from being opened without authorization.

SUMMARY OF INVENTION

An object of the invention is to create a sliding sleeve which cannot be opened by a third party except by force.

On the basis of the state of the art the invention accomplishes this object by means of having the outer sleeve extend beyond the inner sleeve to provide an apertured protruding edge through which a sealed wire is threaded.

Accordingly, the invention makes it possible to retain the advantages of the sliding sleeve, namely tight closure of the interior space against particulate contamination, and a compact construction. Simultaneously, the major disadvantage is overcome, namely the ease of opening.

THE DRAWING

The single FIGURE schematically illustrates a side view partly in section of an embodiment of the invention.

DETAILED DESCRIPTION

The sliding sleeve represented in the drawing consists of the outer sleeve 1, which opens downwards, and the inner sleeve 2, which is open upwards. In accordance with the invention, the outer sleeve 1 is longer than the inner sleeve 2, whereby the outer sleeve 1 forms a protruding edge 3 when the two are pushed together. According to the invention, there are two opposite borings 4 in the protruding edge 3, through which a fastening wire 5 has been drawn, which is secured by a seal 6. At the open end of the outer sleeve 1, two indentations 7 have been provided, which leave the closed end of the inner sleeve 2 partially free. The indentations 7 make it possible to separate the sleeves without problems after removal of the fastening wire 5.

Instead of the indentations 7, a handle can be applied to be bottom of the inner sleeve 2, by means of which the inner sleeve 2 can be pulled out of the outer sleeve 1. Sufficient prevention of unauthorized opening can also be achieved with only one boring 4, through which a sealable fastening wire can also be inserted, or, in which a lock may be mounted.

What is claimed is:

1. In an arrangement for storing samples of materials of biological samples in liquid nitrogen cryobanks wherein the material is in an inner sleeve open at one end and the inner sleeve is telescoped into an outer sleeve which is open at its opposite end, the improvement being the sleeves being cylindrical and forming a tight closure of the interior thereof against particulate contamination without any seals between said sleeves, said outer sleeve being longer than said inner sleeve and having a peripheral edge at its open end protruding beyond said inner sleeve, a portion of said inner sleeve being accessible to the user while said inner sleeve is completely telescoped within said outer sleeve, at least one boring extending through said protruding edge, and tamper indicating means secured through said boring.

2. Arrangement according to claim 1, including two opposite borings in said protruding edge, said tamper indicating means comprising a fastening wire threaded through said borings and a sealing member secured to said wire.

3. Arrangement according to claims 1 and 2, wherein two opposite indentations are at said open end of said outer sleeve and in the wall thereof to leave the closed end of said inner sleeve partially exposed when said two sleeves are locked to each other.

* * * * *